United States Patent [19]

Seidel

[11] Patent Number: 4,601,643

[45] Date of Patent: Jul. 22, 1986

[54] ROTARY COMPRESSOR MACHINES

[75] Inventor: Günter Seidel, Hameln, Fed. Rep. of Germany

[73] Assignee: Aerzener Maschinenfabrik GmbH, Aerzen, Fed. Rep. of Germany

[21] Appl. No.: 460,869

[22] Filed: Jan. 25, 1983

[30] Foreign Application Priority Data

Jan. 29, 1982 [DE] Fed. Rep. of Germany ..... 3202993

[51] Int. Cl.[4] ..... F04B 1/20; F16H 37/06; F04C 11/00

[52] U.S. Cl. ..... 417/247; 74/665 GA; 417/360; 418/200

[58] Field of Search ..... 417/247, 426, 429, 223, 417/238, 319, 360; 74/665 GA; 418/199, 200; 415/DIG. 3; 29/469, 156.4 R

[56] References Cited

U.S. PATENT DOCUMENTS

| | | | |
|---|---|---|---|
| 1,389,782 | 9/1921 | Perrin | 417/319 |
| 1,750,170 | 3/1930 | Frisch | 417/238 |
| 3,088,660 | 5/1963 | Voggenthaler | 418/88 |
| 3,681,919 | 8/1972 | Forster | 417/238 X |
| 3,779,675 | 12/1973 | Magdhuber et al. | 74/665 GA X |
| 4,283,167 | 8/1981 | Bassan et al. | 418/101 X |

FOREIGN PATENT DOCUMENTS

| | | | |
|---|---|---|---|
| 2628387 | 12/1977 | Fed. Rep. of Germany GA | 74/665 |
| 17798 | 3/1928 | Netherlands | 74/665 GA |
| 933973 | 8/1963 | United Kingdom | 417/415 |

*Primary Examiner*—John J. Vrablik
*Assistant Examiner*—Theodore W. Olds
*Attorney, Agent, or Firm*—Pennie & Edmonds

[57] ABSTRACT

A rotary compressor machine comprises at least one rotary compressor member, gearing for driving the member(s), a drive shaft for coupling to a drive motor, and an auxiliary shaft extending axially parallel to the rotary compressor axis and connected coaxially to the drive shaft, said auxiliary shaft having coupling means at its free end opposite the drive shaft for torque transmission. This enables good matching of each machine to operating conditions, even when two machines are coupled in series connection, in respect of efficiency, induction volume flow, and further parameters without incurring special assembly or manufacturing costs.

17 Claims, 18 Drawing Figures

ROTARY COMPRESSOR MACHINES

The present invention relates to rotary compressor machines, e.g. positive-displacement rotary compressors.

The following parameters are important in the design of one-shaft or multi-shaft rotary compressor machines:

1. Induction volume flow
2. Induction pressure
3. Final pressure
4. Induction temperature
5. Conveyor medium The expert can judge from these parameters whether in any given specific case the use of a one-shaft or a multi-shaft machine is expedient.

In principle, for each actual case a machine can be designed and built which at optimal efficiency adheres precisely to certain predetermined values with respect to each of the parameters above. But such machines have to be specially designed and built and are therefore very costly with respect to the planning and manufacture.

The makers of rotary compressor machines have therefore, to reduce the planning and manufacturing costs, long made available series-connected machines in varying sizes with varying possible combinations. In other words, a limited number of machines of various sizes may be used in various series combinations. Such series-connected machines can be substantially more economically made than special machines, because of the greater required quantities, and are therefore cheaper.

Apart from the simple one-stage method of construction, so-called parallel arrangements or tandem arrangements are also at present in use in series combinations.

The advantage of such series-connected machines with respect to the planning and manufacturing costs must however be bought at the cost of a number of disadvantages by comparison with special machines.

Both in the tandem compressor arrangement and in the parallel compressor arrangement of series-connected machines certain rpm ratios and rotary compressor lengths are predetermined by the design for the second stage, so that where there is a deviation from the design (thus in the overwhelming number of cases), lower degrees of efficiency have to be accepted. This leads to higher power requirements as against the special machines and thus to higher energy costs in use.

In the case of the parallel compressor arrangement moreover there are further disadvantages with respect to adaptation of the induction volume flow. Since, due to the turbo-drive which is necessary in such double parallel arrangements, the axial spacings between the main drive shaft and the drive shafts of the two stages of one series are always constant, a compromise usually has to be made in respect of the transmission ratio for the desired induction volume flow of the first stage to the necessary transmission ratio for the ideal intermediate pressure in the second stage. But such compromises lead to lower efficiencies and thus to higher energy costs in operation.

Both in the case of the tandem compressor arrangement and in that of the parallel compressor arrangement, contrary to the one-stage design, special gears and housings have to be provided, since with the tandem arrangement, the power for the second stage has to be additionally transmitted via the gearing for the first stage, and with the parallel arrangement, a special turbo-drive is required for two-stage operation.

An object of the present invention is to provide a rotary compressor machine which permits good adaptation with respect to efficiency, the parameters named above and particularly with respect to the induction volume flow, yet has relatively low manufacturing and/or constructional costs.

According to the invention, there is provided a rotary compressor machine comprising: rotary compressor means; an auxiliary shaft; gear means for coupling the auxiliary shaft to said compressor means; input coupling means for coupling the auxiliary shaft to a drive; and output coupling means for coupling said auxiliary shaft to further equipment.

For further explanation and for better understanding of the invention, rotary compressor machines of the known types as well as embodiments of the invention will now be described, by way of example, with reference to the accompanying drawings, in which.

Previously one-stage rotary compressor machines such as positive displacement compressors fitted with two rotary compressor members were equipped with a transmission and if necessary, with synchronization gear wheels. To reduce the planning and manufacturing costs the makers of rotary compressor machines made available machines of four different sizes, as shown schematically in FIGS. 1, 2, 3 and 4, for series connection.

Figure 1:
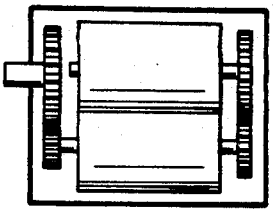
FIGS. 1 to 4 show schematically four different sizes of rotary compressor machines of the known one-stage type.
Figure 2:
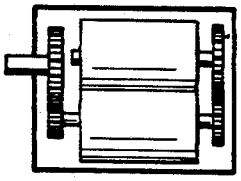
Figure 3:
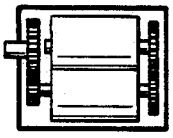
Figure 4:
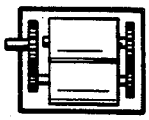
FIG.4 Prior Art
Figure 5:
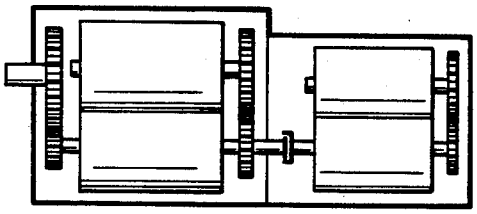
FIGS. 5 to 7 show schematically three different sizes of rotary compressor machines of the known two-stage design (tandem arrangement)
Figure 6:
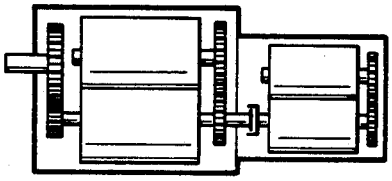
FIG.6 Prior Art
Figure 7:
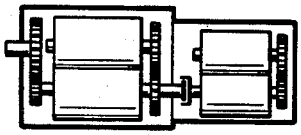
FIG.7 Prior Art
Figure 8:
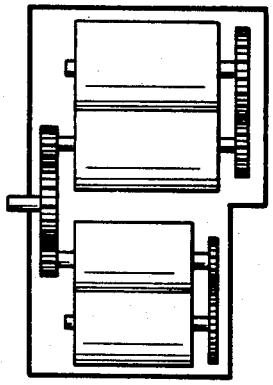
FIGS. 8 to 10 show schematically three different sizes of rotary compressor machines of the known two-stage design (parallel arrangement)
Figure 9:
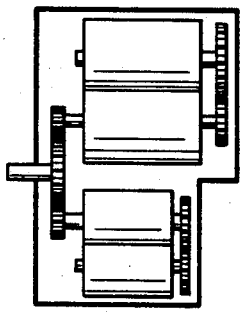
Figure 10:
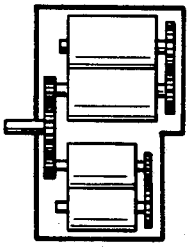
FIG.10 Prior Art
Figure 11:
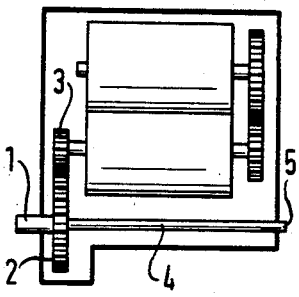
FIGS. 11 to 14 show schematically four different sizes of rotary compressor machines of one-stage design according to the invention.
Figure 12:
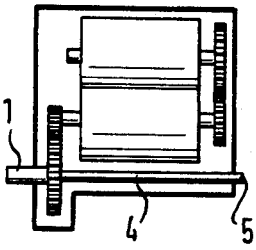
Figure 13:
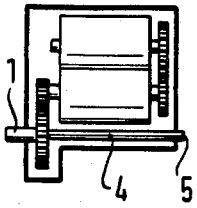
Figure 14:
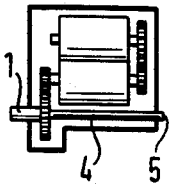
Figure 15:
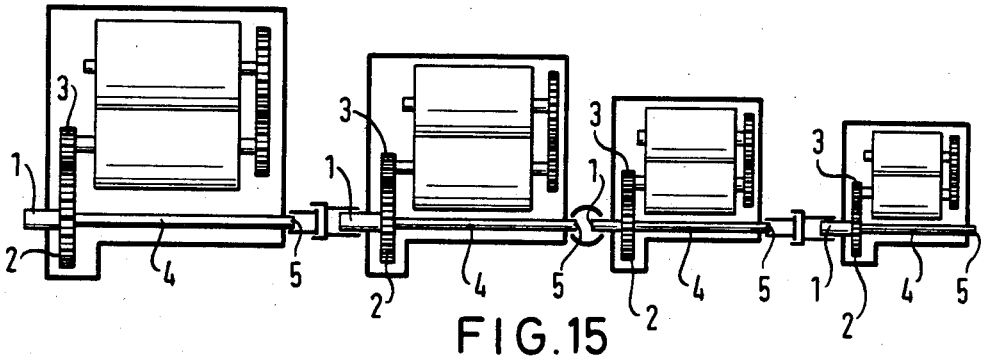
FIG. 15 shows schematically a two- or four-stage rotary compressor machine according to the invention.

If a two-stage design was necessary, previously either two one-stage rotary compressor machines were used with two motors, or a tandem arrangement was chosen with concomitant drive of the second stage (cf. FIGS. 5 to 7) or a parallel arrangement was selected (cf. FIGS. 8 to 10).

But for these known two-stage machines it was necessary to make available special housings and gears in each case. Thus for example the transmission of appropriate size for use in the one-stage design (cf. e.g. the size in FIG. 1) could not be used for the two-stage design in tandem arrangement (cf. e.g. FIG. 5), since with the tanden arrangement the entire torque necessary for driving the second stage passes through the transmission of the first stage. Moreover in such a tandem arrangement with use of rotary compressor members of one size of the one-stage type in the second stage, the intermediate pressure could not be adjusted to the ideal values because of the fixed rotational speed and transmission ratios.

In the known two-stage design in parallel arrangement (cf. FIGS. 8 to 10) again only compromises were possible with respect to the adjustment of the induction volume flow and of the intermediate pressure, as in the double turbo arrangements of this type the necessary turbo-drives of one series always have a constant axial spacing between the main drive shaft and the drive shafts of the two stages and these preset axial spacings cannot be coordinated with the rotational speed of the stages necessary for an optimal operating mode.

These coordination and adjustment problems can be substantially avoided with apparatus according to the invention. Thus rotary compressor machines according to the invention and shown in FIGS. 11 to 18 have an auxiliary shaft 4 extending axially parallel to the rotary compressor member axis and connected coaxially with the respective drive shaft 1 for the gearing 2,3, while said auxiliary shaft 4 has a free end 5 opposite the drive shaft 1 for torque take-out.

Such rotary compressor machines provided with an auxiliary shaft 4 can be produced economically including a housing in series production and in various sizes (see FIGS. 11, 12, 13 and 14). These rotary compressor machines according to the invention can be used as pure one-stage machines (cf. FIGS. 11 to 14) or, for two or more stage machines (cf. FIGS. 15 to 17), they can be connected in series. With use of a one-stage machine ancillary apparatus such as an oil pump or a ventilator wheel can be coupled on the free end 5 of the auxiliary shaft 4. In the case of two or more stage machine designs, the auxiliary shafts 4 serve to transmit the torque to the respective succeeding stage. As a result of use of an auxiliary shaft, torque can be transmitted from one stage to another in each case at the rotational speed of the drive shaft, without thereby overstressing the transmission gear for the respective stage. Since in addition the transmission ratio of each stage has no influence on the rpm of the succeeding stage, the gearing 2,3 of each stage can be individually adjusted to the needs of optimal efficiency.

Figure 16:
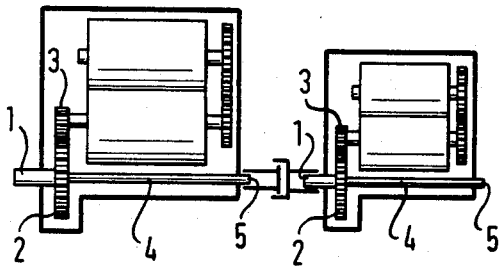
FIG. 16 shows schematically a two-stage rotary compressor machine according to the invention which is composed of two stages of different sizes.
Figure 17:
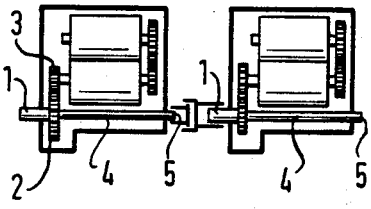
FIG. 17 shows schematically a rotary compressor machine according to the invention composed of two stages of identical size.

As shown schematically in FIGS. 16 and 17, to form a two-stage rotary compressor machine according to the invention, not only can rotary compressor machines of different sizes (FIG. 16) but also those of the same size (FIG. 17) be combined, and thus a machine which is precisely adjusted to the respective purpose can be produced without the cost of a special machine.

Figure 18:
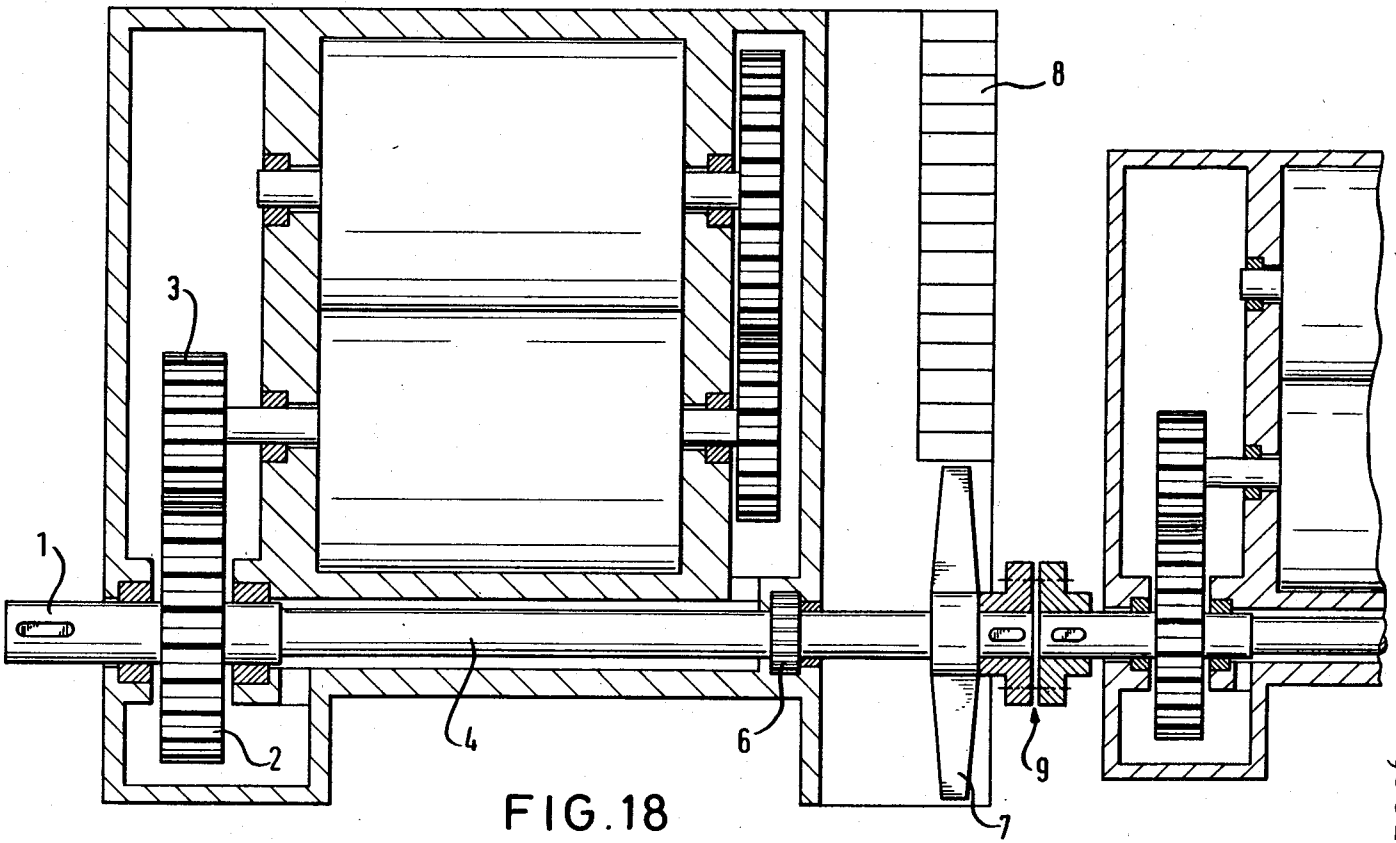
FIG. 18 shows schematically in cross-section an arrangement as in FIG. 16 of a two-stage rotary compressor machine according to the invention with the 2nd stage cut away.

The sectional drawing in FIG. 18 shows schematically the coupling of ancillary apparatus on the auxiliary shaft. Thus, close to the coupling 9 connecting the two stages, a ventilator wheel 7 is arranged on the auxiliary shaft 4 of the first stage, which induces or forces cooling air through a cooling means 8 mounted on the housing of the first stage. In this embodiment, the auxiliary shaft 4 also drives an oil pump 6 which is pushed onto the auxiliary shaft and arranged within a recess located within the housing.

Thus for the first time a rotary compressor machine is provided which has an auxiliary shaft by means of which torque can be taken out at rotational speed of the drive shaft, without thereby overstressing the transmission gearing for the rotary piston(s). Due to this design, it is possible to couple via the respective auxiliary shaft two or more rotary compressor machines to form two or more stages. The stages can be of any desired size, i.e. a stage of equal, larger or smaller size can be coupled to the auxiliary shaft of the first and/or the respectively preceding stage. Because of the respective transmission gearing in each case, all the stages can be adapted to the optimal respectively necessary induction volume flows and intermediate pressures, as a result of which all the stages can be operated in the optimal operational ranges with respect to the parameters named above as regards efficiency.

With the apparatus described above, these opportunities are also provided with series-connected machines. Thus such machines can be used without any modification either as the sole stage or as the first, second or nth stage. Because of these multifarious possible uses, larger quantities are needed than with the series-connected machines previously used, which makes it possible to manufacture them more economically than in the past. Additionally the delivery times are shorter.

A further advantage is that the use of specially and additionally adapted gears such as are required for the parallel and tandem arrangements is not required.

As stated above, stages of any desired size can be coupled up. It is also possible to couple two machines of the same size and to drive the first in the upper peripheral speed range and the second in the lower peripheral speed range.

Where several machines are coupled, each machine in the last analysis works as a single stage which can be adapted by the corresponding choice of the transmission ratio of its gearing to the respective requirements of its objective in the total installation.

The concept can be applied both to rotary compressor machines with one rotary compressor and to those with two or more rotary compressors. It is suitable both for use in one-stage as well as in two- or multi-stage machines. But the concept is especially beneficial for rotary compressor machines with two rotary compressors and two or more stages. In all these cases, however, the drive shaft of the gearing for each succeeding stage is coupled with the free end of the auxiliary shaft of the preceding stage.

In principle, it is possible to assemble the auxiliary shaft from several parts. However a design is advantageous in which the auxiliary shaft is integral with the drive shaft.

In one preferred embodiment of a rotary compressor machine of this type, the drive shaft is supported on both sides of the gear wheel 2. This removes the need for dimensioning of the auxiliary shaft to resist flexure, so that only the transmission of the respectively necessary torque enters into the calculation of the shaft dimensions. Such shafts which are only stressed for torsion, can, as is well known, be of smaller dimensions than those which are stressed also for flexure.

In principle the auxiliary shaft can be of any desired length. But it is expedient if the length of the auxiliary shaft is equal to or greater than the length of the rotary compressor member(s). Thereby, the free end of the auxiliary shaft designed for torque output is located on the side of the rotary compressor machine opposite the drive shaft, which facilitates the coupling up of further machines, since these can be arranged in series one after another. This simplifies the design of the common foundations.

With rotary compressor machines in which the length of the auxiliary shaft is equal to or greater than the length of the rotary compressor member(s), the housing beneath the auxiliary shaft can be designed as a connecting channel for the lubrication of the machine, and thus is additionally used in a special way.

The auxiliary shaft is suitable not only for the coupling up of rotary compressor machines to form two or more stages, but also for the coupling up of additional accessories. Thus for example a ventilator wheel of a cooling arrangement for the machine can be coupled to the auxiliary shaft. However it is also possible to suspend the ventilator wheel directly on the auxiliary shaft, while it can be arranged not only on the end, but also at another point.

An oil pump can also be coupled when using rotary compressor machines of the inventive type to the auxiliary shaft. This oil pump can on the one hand serve to lubricate the gears and bearings, and on the other hand—with wet operation of the machine—it can be used for the conveyance of the lubricant for the rotary compressor members.

In one preferred embodiment the oil pump can be mounted on the auxiliary shaft. This makes it possible to arrange the oil pump not only in the area of the ends of the auxiliary shafts, but also optionally at any point between said ends.

I claim:

1. A rotary compressor machine comprising:

(a) housing means;

(b) rotary compressor means enclosed in said housing means;

(c) an auxiliary shaft enclosed in said housing means and having first and second ends;

(d) gear means disposed within said housing for coupling the auxiliary shaft to said compressor means;

(e) input coupling means which extend out of the housing means for coupling the first end of the auxiliary shaft to a drive for driving the auxiliary shaft at a selected rotational speed; and (f) output coupling means which extend out of the housing means for coupling the second end of said auxiliary shaft to input coupling means of a further machine to drive such further input coupling means at such selected rotational speed wherein said further machine comprises a rotary compressor with the same structure as the first mentioned machine.

2. A machine according to claim 1 wherein said input coupling means includes a drive shaft coupled to the auxiliary shaft.

3. A machine according to claim 2 wherein said drive shaft is integral with said auxiliary shaft.

4. A machine according to claim 1 wherein said compressor means comprises at least one rotary member.

5. A machine according to claim 4 wherein said auxiliary shaft extends axially parallel to the axis of rotation of said rotary member.

6. A machine according to claim 1 wherein there is provided a channel adjacent to and beneath the auxiliary shaft for conducting lubrication.

7. A machine according to claim 1 wherein a ventilator wheel is coupled to the auxiliary shaft.

8. A machine according to claim 7 wherein said ventilator wheel is mounted on the auxiliary shaft.

9. A machine according to claim 1 wherein an oil pump is coupled to the auxiliary shaft.

10. A machine according to claim 9 wherein the oil pump is mounted on the auxiliary shaft.

11. A machine according to claim 1, further comprising a motor coupled to the input coupling means for driving the auxiliary shaft, the direction of rotation of the motor corresponding to the direction of rotation of the auxiliary shaft.

12. A machine according to claim 2, wherein said gear means includes a gear wheel mounted on the drive shaft, and further comprising supports for the drive shaft on both sides of said gear wheel.

13. A machine arrangement comprising first and second machines each including (a) a housing means;

(b) rotary compressor means enclosed in said housing means;

(c) an auxiliary shaft enclosed in said housing means and having first and second ends;

(d) gear means enclosed within said housing for coupling the auxiliary shaft to said compressor means;

(e) input coupling means which extend out of the housing means for coupling the first end of the auxiliary shaft to a drive for driving the auxiliary shaft at a selected rotational speed; and (f) output coupling means which extend out of the housing means for coupling the second end of said auxiliary shaft to input coupling means of a further machine to drive such further input coupling means at such selected rotational speed; wherein the input coupling means of said second machine is coupled to the output coupling means of said first machine.

14. An arrangement according to claim 13 wherein the auxiliary shafts of the respective machines are coupled for rotation at such selected rotational speed.

15. A rotary compressor machine comprising:

(a) rotary compressor means;

(b) an auxiliary shaft having first and second ends and having a length at least equal to the length of the rotary compressor means;

(c) gear means for coupling the auxiliary shaft to said compressor means;

(d) input coupling means for coupling the first end of the auxiliary shaft to a drive;

(e) output coupling means for coupling the second end of the auxiliary shaft to further equipment; and (f) housing means enclosing the rotary compressor means, gear means and the auxiliary shaft, wherein which the input and output coupling means extend out of the housing means for coupling respectively to said drive and to said further equipment, said further equipment being a rotary compressor machine with the same structure as the first mentioned machine.

16. A machine according to claim 15, wherein the rotary compressor means has a longitudinal axis which is substantially parallel to the auxiliary shaft.

17. A machine according to claim 16, wherein the rotary compressor means is laterally spaced from said auxiliary shaft and located substantially only between the ends of said auxiliary shaft.

* * * * *